US011116281B2

(12) United States Patent
Park

(10) Patent No.: US 11,116,281 B2
(45) Date of Patent: Sep. 14, 2021

(54) VENTILATION SOLE FOR FOOTWEAR

(71) Applicant: KYOUNGDO CO., LTD., Gimhae-si (KR)

(72) Inventor: Chun Bae Park, Gimhae-si (KR)

(73) Assignee: Kyoungdo Co., Ltd., Gyeongsangnam-do (KR)

( * ) Notice: Subject to any disclaimer, the term of this patent is extended or adjusted under 35 U.S.C. 154(b) by 124 days.

(21) Appl. No.: 16/108,442

(22) Filed: Aug. 22, 2018

(65) Prior Publication Data

US 2019/0116921 A1 Apr. 25, 2019

(30) Foreign Application Priority Data

Oct. 24, 2017 (KR) ..... 10-2017-0138159

(51) Int. Cl.

| | |
|---|---|
| ***A43B 7/10*** | (2006.01) |
| ***A43B 7/08*** | (2006.01) |
| ***A43B 13/20*** | (2006.01) |
| ***A43B 13/14*** | (2006.01) |

(52) U.S. Cl.

CPC ..... *A43B 7/105* (2013.01); *A43B 7/081* (2013.01); *A43B 7/082* (2013.01); *A43B 7/088* (2013.01); *A43B 13/14* (2013.01); *A43B 13/206* (2013.01)

(58) Field of Classification Search

CPC ..... A43B 7/105; A43B 7/081; A43B 7/082; A43B 7/088; F16K 3/02; F16K 3/0254

See application file for complete search history.

(56) References Cited

U.S. PATENT DOCUMENTS

| | | | | |
|---|---|---|---|---|
| 2,075,458 A * | 3/1937 | Parker | F16K 3/08 137/625.11 |
| 4,431,028 A * | 2/1984 | Hendrick | F16K 3/08 137/625.3 |
| 5,706,905 A * | 1/1998 | Barr | E21B 7/06 175/61 |
| 2012/0102788 A1* | 5/2012 | Park | A43B 7/08 36/25 R |
| 2016/0338444 A1* | 11/2016 | Ochipa | A43B 7/087 |

FOREIGN PATENT DOCUMENTS

KR 19990040067 11/1999

* cited by examiner

*Primary Examiner* — Sharon M Prange
*Assistant Examiner* — Erick I Lopez
(74) *Attorney, Agent, or Firm* — Blank Rome LLP

(57) ABSTRACT

A ventilation sole for footwear, the sole including: a communicating vent-hole through which the inside and outside of footwear communicate with each other to allow air to flow; and a valve selectively opening and closing the communicating vent-hole, wherein the valve includes: a housing module configured to have opposite ends being open such that a channel is provided therein to communicate with the communicating vent-hole; an open-close module configured with a first closing surface and a first through-hole; and a rotation module configured with a second closing surface and a second through-hole, and rotating to move a position of the second through-hole. Accordingly, a wearer can easily open and close the valve by rotating the rotation module according to the intention of the wearer, whereby air inside and outside the footwear can be circulated selectively and optimal foot conditions can be improved.

4 Claims, 5 Drawing Sheets

VENTILATION SOLE FOR FOOTWEAR

CROSS REFERENCE TO RELATED APPLICATION

The present application claims priority to Korean Patent Application No. 10-2017-0138159, filed Oct. 24, 2017, the entire contents of which is incorporated herein for all purposes by this reference.

BACKGROUND OF THE INVENTION

Field of the Invention

The present invention relates generally to a ventilation sole for footwear. More particularly, the present invention relates to a ventilation sole for footwear, the sole including a communicating vent-hole through which the inside and outside of footwear communicate with each other to allow air to flow, and a valve selectively opening and closing the communicating vent-hole. In addition, the valve of the ventilation sole is provided with a rotation module such that a wearer can easily open and close the valve by rotating the rotation module according to the intention of the wearer, whereby air inside and outside the footwear can be circulated selectively and optimal foot conditions can be improved.

Description of the Related Art

In general, footwear collectively refers to an item that is worn on the foot when a person stands or walks on the ground. Footwear is worn on the feet to protect the feet, to facilitate easy movement, and in certain cases, to be utilized as an item of decoration.

Various kinds of footwear have been manufactured in order to meet the functional aspects of the footwear required in accordance with diversification of activity areas and living environments of people as well as the improvement of the living standard in recent years. Examples of footwear are sneakers, dress shoes, safety shoes, rain boots, hiking boots, and the like.

Footwear is able to provide convenience, efficiency, and protection to people, but it is difficult to ventilate the footwear due to the structure of the footwear that covers the feet in a closed manner.

In addition, the temperature inside the footwear is increased due to the friction between the feet and a lining of the footwear. Furthermore, the humidity inside the footwear is increased due to the sweat generated from the foot such that odor is generated and the wearer may suffer from chronic diseases such as tinea pedis.

For these reasons, when a sole for footwear is configured with a vent-hole such that the inside and outside of the footwear communicate with each other to allow air to flow, contaminants or water outside the footwear flows into the footwear such that the foot protection performance is deteriorated and the foot is wet by liquid such as water, causing discomfort to the wearer.

In addition, when the footwear contacts the ground, air of the sole for the footwear is discharged to the outside due to the weight of the person, whereby it is difficult to effectively absorb the impact generated while the wearer is walking.

Accordingly, a solution for such problems is required.

SUMMARY OF THE INVENTION

Accordingly, the present invention has been made keeping in mind the above problems occurring in the related art, and the present invention is intended to propose a ventilation sole for footwear, the sole including a communicating vent-hole through which the inside and outside of footwear communicate with each other to allow air to flow and a valve selectively opening and closing the communicating vent-hole. In detail, the valve of the ventilation sole is provided with a rotation module such that a wearer can easily open and close the valve by rotating the rotation module according to the intention of the wearer, whereby air inside and outside the footwear can be circulated selectively and optimal foot conditions can be ensured.

The technical objects of the present invention will not be limited only to the objects described above. Accordingly, additional technical objects of the present application will be set forth in part in the description which follows and in part will become apparent to those having ordinary skill in the art upon examination of the following or may be learned from practice of the present application.

In order to achieve the above object, there is provided a ventilation sole for footwear according to the present invention, the kit including: a communicating vent-hole through which the inside and outside of footwear communicate with each other to allow air to flow; and a valve selectively opening and closing the communicating vent-hole, wherein the valve includes: a housing module inserted in the communicating vent-hole and configured to have opposite ends being open such that a channel is provided therein to communicate with the communicating vent-hole; an open-close module inserted in the housing module, configured with a first closing surface closing the channel, and with a first through-hole at the first closing surface to communicate with at least a part of the channel; and a rotation module provided inside the housing module while coming into contact with the first closing surface of the open-close module, configured with a second closing surface closing the channel, and with a second through-hole at the second closing surface to communicate with at least a part of the channel and to correspond to the first through-hole, the rotation module rotating to move a position of the second through-hole.

The open-close module may be configured such that the first through-hole has an area smaller than a half of a cross-sectional area of the channel.

The valve may be provided at a portion where the communicating vent-hole of the sole communicates with the outside of footwear.

The rotation module may be disposed such that the second closing surface is exposed at a portion where the communicating vent-hole communicates with the outside.

The rotation module may be configured with a grip recess in the second closing surface for manipulating rotation of the rotation module.

The rotation module may be configured with a protruding portion protruding toward the first closing surface of the open-close module.

The open-close module may be configured with a recessed portion corresponding to the protruding portion of the rotation module.

The open-close module may be configured to be an elastic body.

The valve may further include an immobilizing module, which is coupled with the housing module, prevents the open-close module from rotating with the rotation module, and immobilizes the open-close module.

A ventilation sole for footwear according to an embodiment of the present invention has the following effects.

A wearer rotates a rotation module according to the intention to open and close a valve, whereby air inside and outside footwear can be selectively circulated.

Thus, it is possible to circulate air inside and outside the footwear according to needs of the wearer or external environment to improve foot protection and optimal foot conditions.

In addition, the valve is provided at a portion where a communicating vent-hole of the sole communicates with the outside of the footwear, and a grip recess for manipulating the rotation module is disposed to be exposed at a portion where the communicating vent-hole communicates with the outside of the footwear, whereby the wearer easily manipulates the rotation module while wearing the footwear to selectively circulate air inside and outside the footwear.

The effects that may be gained from the embodiment of the present invention will not be limited only to the effects described above. Accordingly, additional effects of the present application will be set forth in part in the description which follows and in part will become apparent to those having ordinary skill in the art upon examination of the following or may be learned from practice of the present application. More specifically, unintended effects obtained upon the practice of the present invention may also be derived by anyone having ordinary skill in the art.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, exemplary embodiments of the present invention will be described in detail with reference to the accompanying drawings. However, in the following description, it is to be noted that, when the functions of conventional elements and the detailed description of elements related with the present invention may make the gist of the present invention unclear, a detailed description of those elements will be omitted.

Further, in the description of the present invention, terms indicating directions, for example, "front", "rear", "upper", or "lower" are intended to enable those skilled in the art to clearly understand the invention, and are merely relative directions, thus the scope of the invention is not limited thereby.

A configuration and use of a ventilation sole for footwear according to an embodiment of the present invention will be described in detail with reference to FIGS. 1A to 5.

The ventilation sole for footwear according to the embodiment of the present invention can be applied to various kinds of footwear, but the present embodiment is of a case in which a ventilation sole is applied to safety shoes.

Figure 1A:
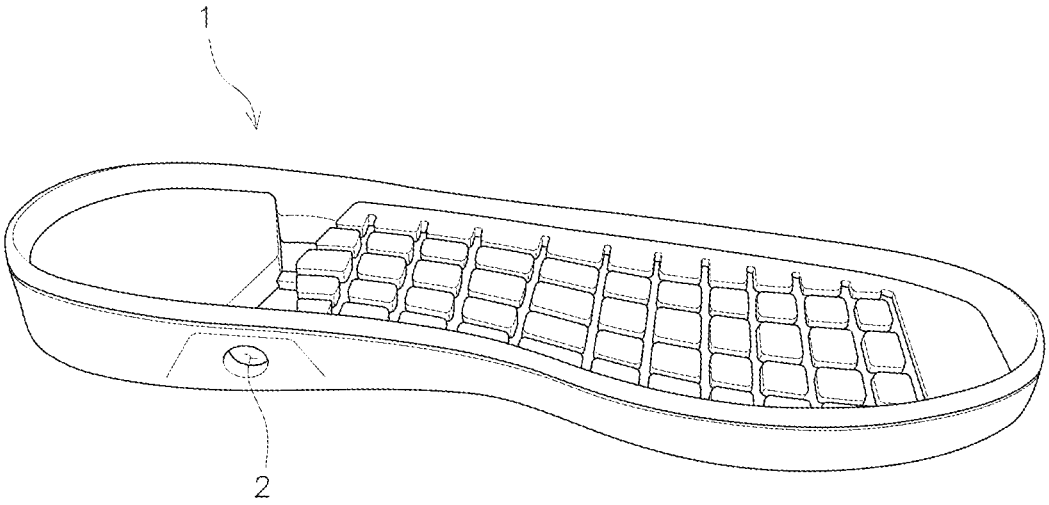
FIGS. 1A and 1B are diagrams illustrating a communicating vent-hole configured on a ventilation sole for footwear according to an embodiment of the present invention.
Figure 1B:
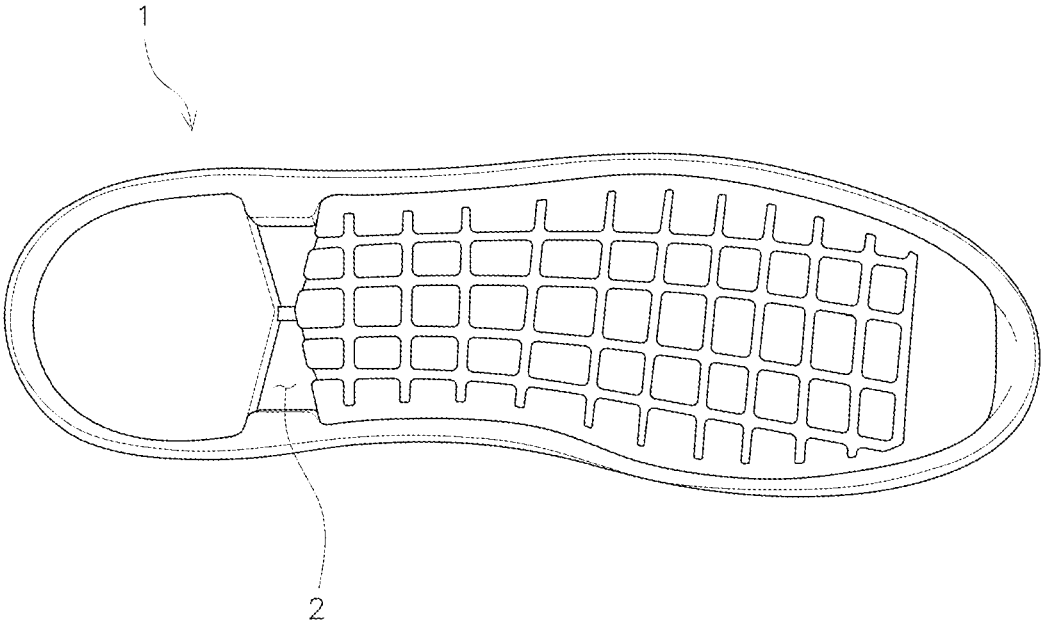
Figure 2:
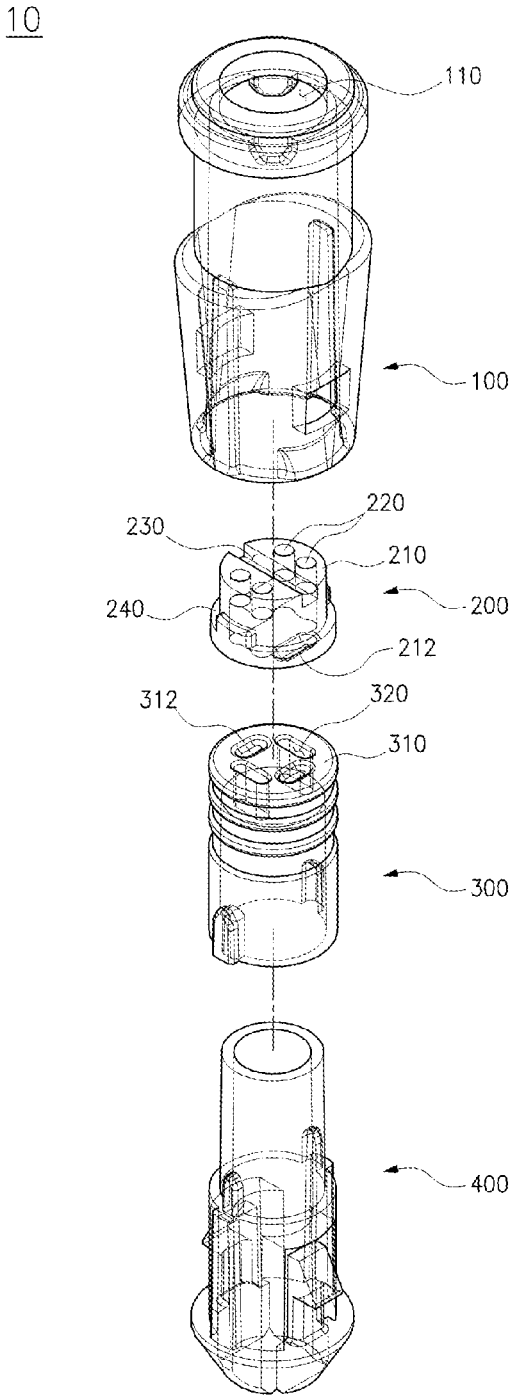
FIG. 2 is a diagram roughly illustrating a valve of the ventilation sole for footwear according to the embodiment of the present invention.
Figure 3:
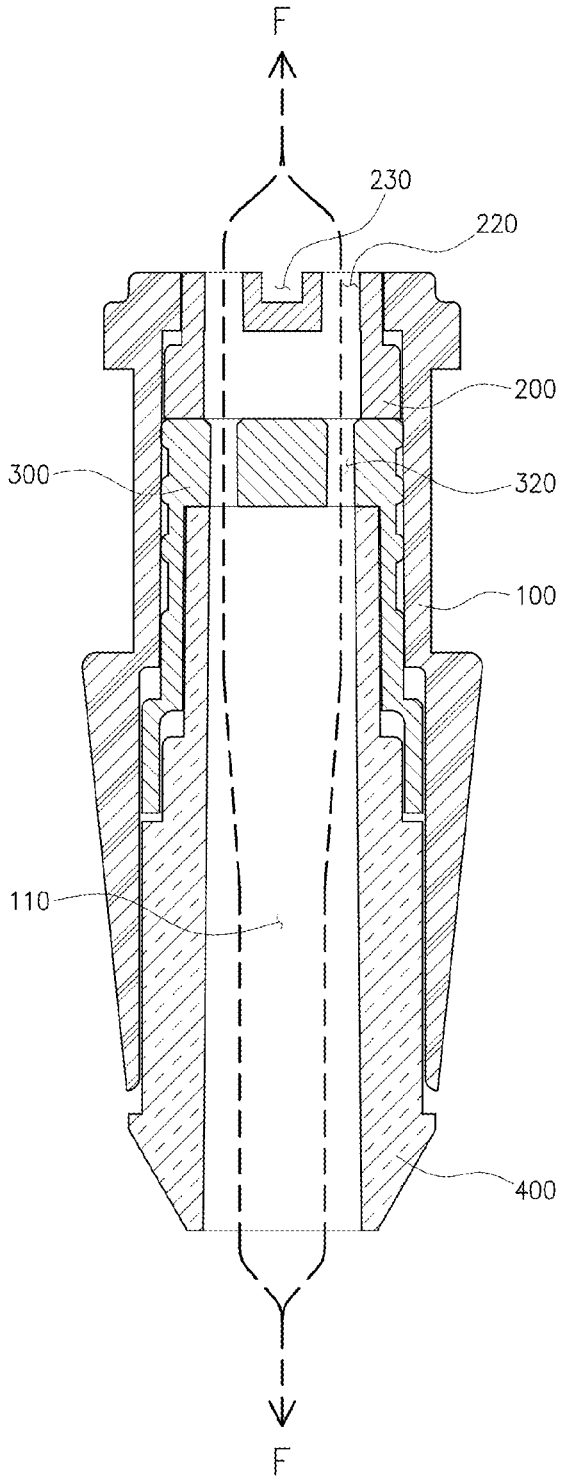
FIG. 3 is a cross-sectional view illustrating the valve of the ventilation sole for footwear according to the embodiment of the present invention.

FIGS. 1A and 1B are diagrams illustrating a communicating vent-hole configured on a ventilation sole for footwear according to an embodiment of the present invention; FIG. 2 is a diagram roughly illustrating a valve of the ventilation sole for footwear according to the embodiment of the present invention; and FIG. 3 is a cross-sectional view illustrating the valve of the ventilation sole for footwear according to the embodiment of the present invention.

Figure 4A:
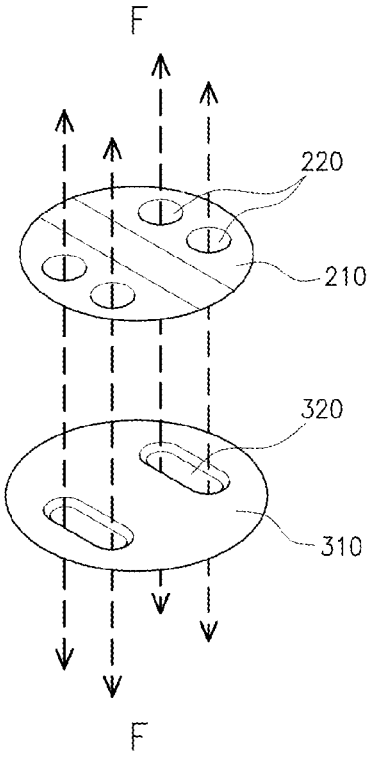
FIGS. 4A and 4B are diagrams illustrating that communicating vent-hole is opened and closed according to a rotation of a rotation module of the valve of the ventilation sole for footwear according to the embodiment of the present invention.
Figure 4B:
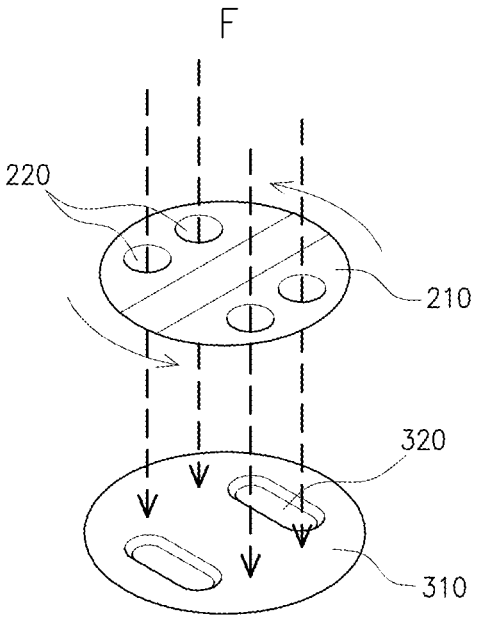
Figure 5:
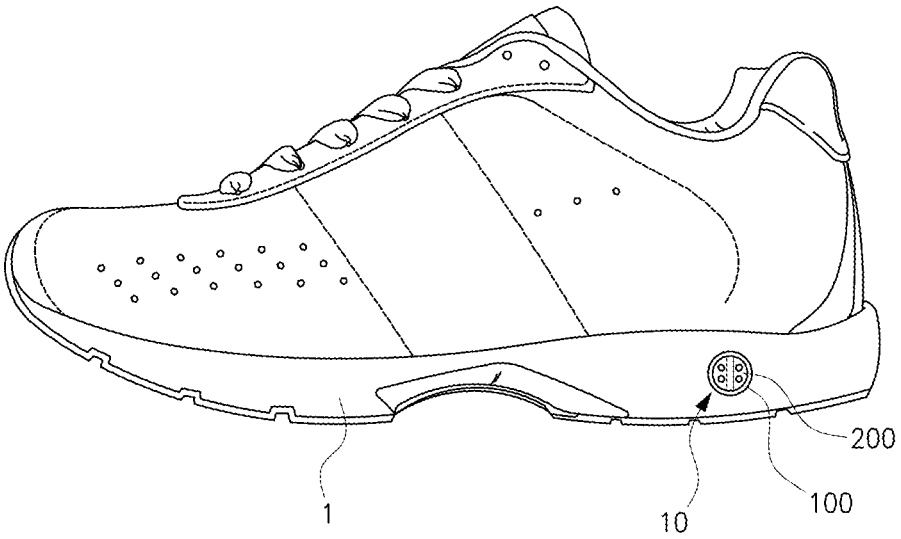
FIG. 5 is a diagram illustrating a ventilation sole for footwear provided with the valve according to the embodiment of the present invention.

FIGS. 4A and 4B are diagrams illustrating that communicating vent-hole is opened and closed according to a rotation of a rotation module of the valve of the ventilation sole for footwear according to the embodiment of the present invention; and FIG. 5 is a diagram illustrating a ventilation sole for footwear provided with the valve according to the embodiment of the present invention.

In the ventilation sole for footwear according to the embodiment of the present invention, a communicating vent-hole 2 through which the inside and outside of footwear communicate with each other to allow air to flow is provided on a sole 1 as shown in FIGS. 1A, 1B, and 2. With regard to a ventilation sole for footwear provided with a valve 10 selectively opening and closing the communicating vent-hole, the valve 10 includes a housing module 100, an open-close module 300, and a rotation module 200 as shown in FIG. 2.

The housing module 100 is inserted in the communicating vent-hole 2, and configured to have opposite ends being open such that a channel 110 is provided therein to communicate with the communicating vent-hole 2.

For example, in the present embodiment, the housing module 100 is configured as a cylindrical shape, configured to have the open ends such that the channel 110 is provided therein to communicate with the communicating vent-hole 2. In addition, the housing module 100 is configured in which air introduced through one of the ends of the channel 110 is discharged through a remaining end.

That is, the housing module 100 is configured to allow air to flow through the channel 110, the air introduced and discharged through the ends of the communicating vent-hole 2 of the sole for footwear.

Here, the inside of the housing module 100 is configured to have a space for storing the open-close module 300 and the rotation module 200 which will be described later.

The open-close module 300 is inserted in the housing module 100 and provided with a first closing surface 310 closing the channel 110, and with a first through-hole 320 at the first closing surface 310 to communicate with at least a part of the channel 110.

In detail, the open-close module 300 is coupled with the housing module 100 by being inserted therein. The circumferential shape of the first closing surface 310 is configured to be same with the circumferential shape of a cross-sectional area of the channel 110 such that the first closing surface 310 closes the channel 110. The first closing surface 310 is configured with at least one first through-hole 320 such that air introduced and discharged through the ends of the communicating vent-hole 2 of the sole for footwear flows through the channel 110 and the first through-hole 320.

Here, the open-close module 300 inserted in the housing module 100 is configured with a protruding portion at an outer side surface thereof and the housing module 100 is configured with a recessed portion at a position on an inner surface corresponding to the open-close module 300. Thus, the protruding portion of the open-close module 300 is configured to be inserted in the recessed portion of the housing module 100 such that the open-close module 300 stays immobilized inside the housing module 100. A shape and a configuration of this are not limited, provided that the open-close module 300 is configured to be coupled inside the housing module 100.

The rotation module 200 is provided inside the housing module 100 while coming into contact with the first closing surface 310 of the open-close module 300. In addition, the rotation module 200 is configured with a second closing surface 210 closing the channel 110 and configured with a second through-hole 220 at the second closing surface 210 to communicate with at least a part of the channel 110 and to correspond to the first through-hole 320. Furthermore, the rotation module 200 rotates to move a position of the second through-hole 220.

In detail, the rotation module 200 is inserted into the housing module 100, and provided to come into contact with the first closing surface 310 of the open-close module 300 inserted inside the housing module 100. It is preferable that the circumferential shape of the second closing surface 210 is configured to be same with the circumferential shape of the first closing surface 310 to close the channel 110 firmly. The rotation module 200 is configured in which the second through-hole 220 is provided at a position corresponding to the position of the first through-hole 320.

That is, as shown in FIG. 3, the housing module 100 is configured with the channel 110 therein and configured to have the open ends to allow air flowing through the communicating vent-hole 2 to flow and communicate through the open ends of the channel 110. The rotation module 200 is configured to be inserted into the housing module 100 for coupling and disposed at an end of the housing module 100. The open-close module 300 is configured to be inserted into the housing module 100 for coupling and come into contact with the rotation module 200.

In addition, the first through-hole 320 of the open-close module 300, which is configured to communicate with at least a part of the channel 110, and the second through-hole 220 of the rotation module 200 are configured to correspond to each other such that air introduced and discharged through the ends of the channel 110 flows through the first through-hole 320 and the second through-hole 220.

Here, multiple second through-holes 220 may be provided. Provided that air introduced or discharged through the ends of the channel 110 is allowed to flow through the first through-hole 320 and the second through-hole 220, the multiple second through-holes 220 may be provided, and shapes and configurations of this are not limited.

According to such configuration, it is possible to allow air inside and outside footwear to flow and circulate through the communicating vent-hole 2.

Meanwhile, the open-close module 300 may be configured such that the first through-hole 320 has an area smaller than a half of a cross-sectional area of the channel 110.

In addition, the second through-hole 220 corresponding to the first through-hole 320 also may be configured to have an area smaller than a half of the cross-sectional area of the channel 110. Here, provided that the second through-hole 220 is configured to have an area smaller than that of the first through-hole 320 and the area of the second through-hole 220 is configured to be superimposed onto and included in the area of the first through-hole 320, the shapes and the number of the second through-hole 220 are not limited and can be provided in various ways.

According to such configuration, when rotating the second through-hole 220 which corresponds to the first through-hole 320 with a predetermined degree, the second through-hole 220 is located where the first through-hole 320 is not provided, whereby it is possible to close the channel 110 effectively.

A detailed description will be provided with reference to FIGS. 4A and 4B. As shown in FIG. 4A, when the second through-hole 220 of the rotation module 200 and the first through-hole 320 of the open-close module 300 are positioned at a corresponding position, the valve 10 stays in an opened state such that air flows through the communicating vent-hole and the inside and outside air of footwear is circulated.

On the other hand, as shown in FIG. 4B, when the second through-hole 220 is moved by rotation of the rotation module 200 such that the second through-hole 220 of the rotation module 200 and the first through-hole 320 of the open-close module are not positioned at a corresponding position, the valve 10 stays in a closed state such that air is impossible to flow through the communicating vent-hole 2, whereby air circulation between the inside and outside of footwear is impossible.

Meanwhile, the valve 10 may further include an immobilizing module 400, which is coupled with the housing module 100, prevents the open-close module 300 from rotating with the rotation module 200, and immobilizes the open-close module 300.

For example, in the present embodiment, the immobilizing module 400 is configured as a cylindrical shape and the immobilizing module 400 is inserted into the open-close module 300 such that a protruding portion of the immobilizing module 400 and a recessed portion of the open-close module 300 are configured to couple to each other. However, provided that the immobilizing module 400 is coupled to the housing module 100, configured to have ends both being opened in order to allow air introduced or discharged through the ends of the communicating vent-hole 2 of the sole for footwear to flow through the channel 110 of the housing module 100 and through the first through-hole 320 of the open-close module 300, and configured to prevent the open-close module 300 from rotating with the rotation module 200, a shape and a configuration thereof are not limited and can be provided in various ways.

Meanwhile, the rotation module 200 may be configured with a protruding portion 212 configured to protrude toward the first closing surface 310 of the open-close module 300.

In addition, the open-close module 300 may be configured with a recessed portion 312 corresponding to the protruding portion 212 of the rotation module 200.

According to such configuration, it is possible to prevent arbitrary rotation of the rotation module 200 regardless of the intention of the wearer.

Provided that the second through-hole 220 is configured to correspond to the first through-hole 320, that the protruding portion 212 is configured to be coupled with the recessed portion 312, and that the recessed portion 312 is configured to intersect lengthwise with the first through-hole 320, it is possible to allow air flowing through the channel 110 to flow through the first through-hole 320 and the second through-hole 220.

In the above-described configuration, when no external force for rotation is transmitted to the rotation module, the rotation of the rotation module 200 is impossible without an external force of the wearer because the protruding portion 212 and the recessed portion 312 are coupled with each other. Thus, the valve 10 selectively opening and closing the communicating vent-hole 2 stays in an opened state, thereby allowing air to flow.

Meanwhile, the open-close module 300 may be configured to be an elastic body.

In the above-described configuration, when the wearer applies a force to rotate the rotation module 200, the protruding portion 212 is easily detached from the recessed portion 312 of the open-close module 300 which is configured to be an elastic body, the protruding portion 212 is rotated toward the first through-hole 320 which is formed spaced apart from the recessed portion 312 such that the protruding portion 212 itself is coupled with and closes the first through-hole 320 and the channel 110 is closed. Thus, the valve 10 selectively opening and closing the communicating vent-hole 2 stays in a closed state, thereby not allowing air to flow.

Meanwhile, as shown in FIG. 5, the valve 10 may be provided at a portion where the communicating vent-hole 2 of the sole communicates with the outside of footwear.

In addition, the rotation module 200 may be disposed such that the second closing surface 210 is exposed at a portion where the communicating vent-hole 2 communicates with the outside of footwear.

In the above-described configuration, the wearer easily rotates the rotation module 200 while wearing the footwear, whereby it is possible to circulate air inside the footwear with the outside air by opening and closing the valve 10 according to the intention of the wearer.

Here, the rotation module 200 may be configured with a grip recess 230 in the second closing surface 210 for manipulating rotation of the rotation module 200.

According to the above-described configuration, it is possible for the wearer to easily rotate the rotation module 200.

In the present embodiment, the grip recess 230 is configured in the second closing surface 210 in a recessed manner. However, provided that the grip recess 230 is configured such that the wearer easily rotates the rotation module 200 by manipulation, the shape and the configuration of the grip recess 230 are not limited.

According to the above-described configuration, it is possible to selectively circulate air inside and outside the footwear through a simple manipulation in which the wearer rotates the rotation module 200 of the valve 10.

In other words, when concerning about inflow of external contaminants or water, it is easy to keep the valve 10 in a closed state. On the other hand, when air circulation between the inside and outside of footwear is required due to the increases of the humidity, temperature, and the like inside the footwear, it is possible to selectively circulate air inside and outside the footwear by opening the valve 10. Accordingly, it is possible to provide effective foot protection against shock and optimal foot conditions.

Although the preferred embodiments of the present invention have been described, those skilled in the art will appreciate that various modifications, additions and substitutions are possible, without departing from the scope and spirit of the invention. Thus, the above-described embodiments should be regarded as illustrative rather than restrictive. Accordingly, the present invention is intended to cover not only the exemplary embodiments, but also various alternatives, modifications, equivalents and other embodiments that may be included within the spirit and scope of the present invention as defined by the appended claims.

What is claimed is:

1. A ventilation sole for footwear, the sole comprising:

a communicating vent-hole through which the inside and outside of footwear communicate with each other to allow air to flow; and a valve selectively opening and closing the communicating vent-hole, wherein the valve includes:

a housing module inserted in the communicating vent-hole and configured to have opposite ends being open such that a channel is provided therein to communicate with the communicating vent-hole;

an open-close module inserted in the housing module, configured with a first closing surface closing the channel, and with a first through-hole at the first closing surface to communicate with at least a part of the channel; and a rotation module provided inside the housing module while coming into contact with the first closing surface of the open-close module, configured with a second closing surface closing the channel, and with a second through-hole at the second closing surface to communicate with at least a part of the channel and to correspond to the first through-hole, the rotation module rotating to move a position of the second through-hole, wherein the rotation module is configured with a protruding portion protruding toward the first closing surface of the open-close module, the open-close module is configured to be an elastic body and with a recessed portion corresponding to the protruding portion of the rotation module, wherein when no external force for rotation is transmitted to the rotation module, the protruding portion and the recessed portion are coupled with each other, and when the external force is applied to rotate the rotation module, the protruding portion is detached from the recessed portion of the open-close module and the protruding portion is rotated toward the first through-hole which is formed spaced apart from the recessed portion such that the protruding portion itself is coupled with and closes the first through-hole.

2. The sole of claim 1, wherein the open-close module is configured such that the first through-hole has an area smaller than a half of a cross-sectional area of the channel.

3. The sole of claim 1, wherein the rotation module is configured with a grip recess in the second closing surface for manipulating rotation of the rotation module.

4. The sole of claim 1, wherein the valve further includes an immobilizing module, which is coupled with the housing module, prevents the open-close module from rotating with the rotation module, and immobilizes the open-close module.

* * * * *